US011629722B2

(12) United States Patent
Houle et al.

(10) Patent No.: US 11,629,722 B2
(45) Date of Patent: Apr. 18, 2023

(54) IMPELLER SHROUD FREQUENCY TUNING RIB

(71) Applicant: PRATT & WHITNEY CANADA CORP., Longueuil (CA)

(72) Inventors: Nicola Houle, Montreal (CA); Bernard Chow, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/407,277

(22) Filed: Aug. 20, 2021

(65) Prior Publication Data

US 2023/0059085 A1 Feb. 23, 2023

(51) Int. Cl.

| | |
|---|---|
| ***F04D 29/66*** | (2006.01) |
| ***F04D 17/10*** | (2006.01) |
| ***F04D 29/22*** | (2006.01) |

(52) U.S. Cl.

CPC ..... *F04D 17/10* (2013.01); *F04D 29/22* (2013.01); *F04D 29/668* (2013.01)

(58) Field of Classification Search

CPC ..... F04D 29/668; F04D 17/10; F04D 29/22

See application file for complete search history.

(56) References Cited

U.S. PATENT DOCUMENTS

| | | | | |
|---|---|---|---|---|
| 4,626,168 | A | 12/1986 | Osborne et al. | |
| 6,183,195 | B1 * | 2/2001 | Tremaine | F04D 27/023 415/173.2 |
| 7,189,059 | B2 * | 3/2007 | Barton | F04D 29/685 415/191 |
| 8,197,189 | B2 * | 6/2012 | Bonniere | F01D 25/24 415/119 |
| 9,410,436 | B2 | 8/2016 | Kulathu et al. | |

* cited by examiner

*Primary Examiner* — Sabbir Hasan

(74) *Attorney, Agent, or Firm* — Norton Rose Fulbright Canada LLP.

(57) ABSTRACT

A frequency tuning rib is provided on an impeller shroud to alter a natural frequency of the shroud so as to avoid coincidence with the aerodynamic excitation frequencies to which the shroud is exposed during engine operation.

13 Claims, 4 Drawing Sheets

IMPELLER SHROUD FREQUENCY TUNING RIB

TECHNICAL FIELD

The application relates generally to impeller shrouds, and more particularly to frequency tuning of impeller shrouds.

BACKGROUND OF THE ART

A centrifugal fluid machine, such as a centrifugal compressor, generally includes an impeller which rotates within a shroud disposed around the impeller. The impeller includes a hub mounted to a drive shaft so as to be rotated therewith. Blades of the impeller extend from the hub and are typically arranged to redirect an axially-directed inbound gas flow radially outwardly. The shroud is disposed as close as possible to tips of the blades such as to minimize tip clearance and thereby maximize an amount of the fluid being worked on by the impeller.

In use, the impeller shroud is exposed to blade count excitation. The impeller shroud may be stimulated by multiple impulses, which in turn drive responses corresponding to various natural frequencies of the shroud over a variety of engine operating speeds, exposing the impeller shroud to a large variety of aerodynamic stimuli. Such stimuli if not properly accounted for may cause the impeller shroud to undergo high cycle fatigue (HCF) distress.

Although existing impeller shrouds were satisfactory to a certain degree, room for improvement remains.

SUMMARY

In accordance with a first aspect, there is provided a centrifugal compressor comprising: an impeller rotatable about a central axis, the impeller having blades extending from a hub to blade tips between an inlet and an outlet; and a shroud annularly extending around the blade tips of the impeller and extending in a streamwise direction between an inducer end at the inlet of the impeller and an exducer end at the outlet of the impeller, the shroud having a gaspath surface facing the impeller and a back surface opposed to the gaspath surface, the back surface having a tuning rib extending therefrom at either or both the inducer end and the exducer end of the shroud, the tuning rib configured to alter a natural frequency of the shroud so as to avoid coincidence with aerodynamic excitation frequencies to which the shroud is configured to be exposed to during use.

In accordance with a second aspect, there is provided an impeller shroud for an impeller of a centrifugal compressor, comprising: a shroud structural member configured to be mounted to a surrounding structure; a gaspath wall supported in a cantilevered manner by the shroud structural member, the gaspath wall circumferentially extending around a central axis between an axial inducer end and a radial exducer end, the gaspath wall having a gaspath surface facing the central axis and an opposed back surface facing away from the central axis, and a frequency tuning rib at the radial exducer end, the frequency tuning rib extending in an axial direction from the back surface of the shroud all around the central axis.

In accordance with a third aspect, there is provided a method of tuning an impeller shroud extending annularly around an impeller mounted for rotation about a central axis, the impeller shroud extending streamwise between an inducer end and an exducer end, the impeller shroud having a gaspath surface facing the impeller and a back surface facing away from the impeller, the method comprising: (a) designing the impeller shroud; (b) testing the impeller shroud for high cycle fatigue problems based on a natural frequency of the impeller shroud; and (c) after steps (a) and (b), altering the natural frequency of the impeller shroud by adding a rib at the inducer or exducer end of the impeller shroud, the rib projecting from the back surface of the impeller shroud.

In accordance with a still further aspect, there is provided a method of tuning the natural frequency of an impeller shroud surrounding an impeller having impeller blades mounted for rotation about a central axis, the impeller shroud extending streamwise between an inducer end and an exducer end, the impeller shroud having a gaspath surface facing the impeller and a back surface facing away from the impeller, the method comprising: ascertaining aerodynamic excitation frequencies to which the impeller shroud is configured to be exposed to during use, adjusting the natural frequency of the impeller shroud such as to mitigate the aerodynamic excitation frequencies by adding a tuning rib on the back surface of the impeller shroud, the tuning rib provided at the inducer end or the exducer end.

BRIEF DESCRIPTION OF THE DRAWINGS

Reference is now made to the accompanying figures in which.

DETAILED DESCRIPTION

Figure 1:
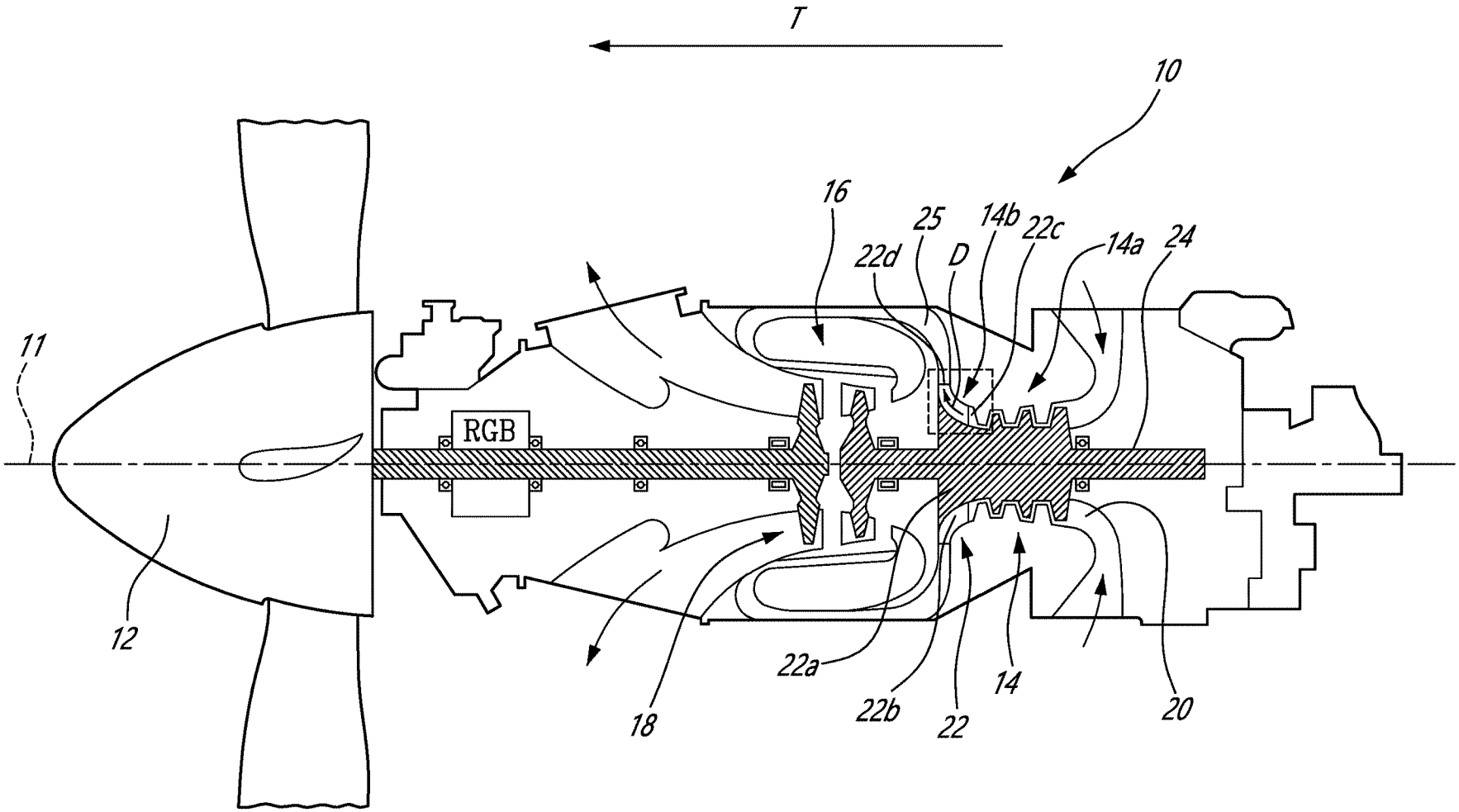
FIG. 1 is a schematic cross-section view of a gas turbine engine including a centrifugal compressor having an impeller surrounded by a cantilevered impeller shroud extending from an impeller end to an exducer end.

FIG. 1 illustrates an aircraft engine, for instance a gas turbine engine 10 of a type preferably provided for use in subsonic flight, and in driving engagement with a rotatable load, such as the exemplified propeller 12. The engine 10 has in serial flow communication a compressor section 14 for pressurizing the air, a combustor 16 in which the compressed air is mixed with fuel and ignited for generating an annular stream of hot combustion gases, and a turbine section 18 for extracting energy from the combustion gases.

It should be noted that the terms "upstream" and "downstream" used herein refer to the direction of an air/gas flow passing through an annular gaspath 20 of the engine 10. It should also be noted that the term "axial", "radial", "angular" and "circumferential" are used with respect to a central axis 11 of the annular gaspath 20, which may also be the centerline of the engine 10.

The exemplified engine 10 is depicted as a reverse-flow engine in which the air flows in the annular gaspath 20 from a rear of the engine 10 to a front of the engine 10 relative to a direction of travel T of the engine 10. This is opposite to a through-flow engine in which the air flows within the annular gaspath 20 in a direction opposite the direction of travel T, from the front of the engine towards the rear of the gas turbine engine 10. Even though the following description and accompanying drawings specifically refer to a reverse-flow turboprop engine as an example, it is understood that aspects of the present disclosure may be equally applicable to other types of engines, including but not limited to turboshaft and turboprop engines, auxiliary power units (APU), and the like.

The compressor section 14 of the engine 10 includes one or more compressor stages disposed in flow series. For instance, the compressor section 14 may comprise a number of serially interconnected axial compressor stages 14*a* feeding into a centrifugal compressor 14*b* disposed downstream of the axial compressor stages 14*a*. The centrifugal compressor 14*b* includes an impeller 22 drivingly engaged by a shaft 24 of the engine 10. The impeller 22 and the shaft 24 are rotatable about the central axis 11 of the engine 10. The impeller 22 has a hub 22*a* and blades 22*b* protruding from the hub 22*a*. The blades 22*b* are circumferentially distributed on the hub 22*a* about the central axis 11 and protrudes from a root at the hub 22*a* to a tip spaced apart from the hub 22*a*. As shown in FIG. 1, the impeller blades 22*b* extend from an axial inlet or inducer end 22*c* of the impeller 22 to a radial outlet or exducer end 22*d* at which the gas flow exits the impeller 22 substantially radially (e.g. 90±15 degrees) relative to the central axis 11. The impeller blades 22*b* define an intermediate bend from axial to radial between the inducer end 22*c* and the exducer end 22*d*.

Figure 2:
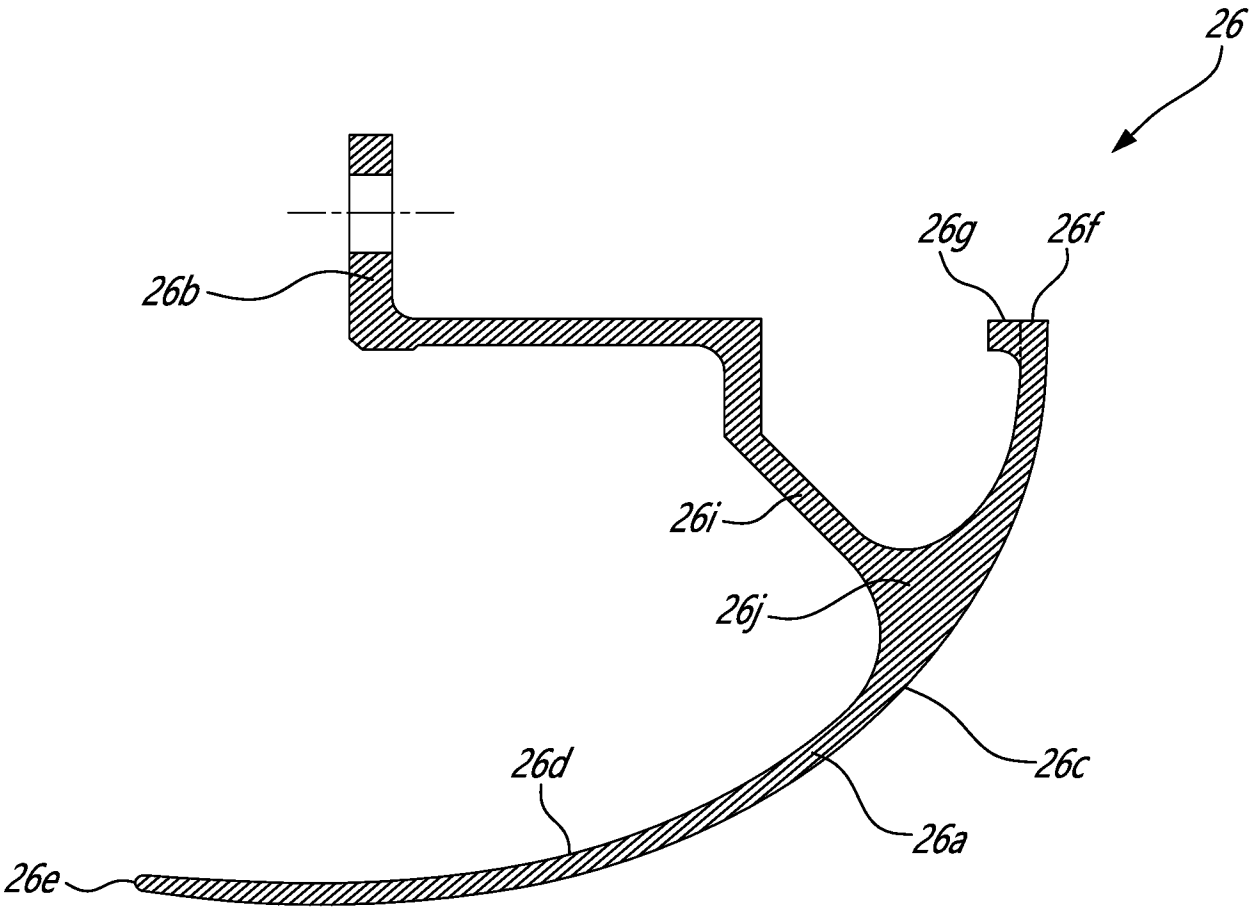
FIG. 2 is a schematic cross-section view of the impeller shroud having a frequency tuning rib provided at the exducer end of the shroud, the tuning rib configured to adjust the natural frequencies and ensure they do not interfere with the engine operating speeds.

A static structure including an impeller shroud 26 (FIG. 2) annularly extends around the blades 22*b*. The impeller shroud 26 may be mounted in a cantilevered fashion to a structural member (not shown) of the engine 10. For instance, as shown in FIG. 2, the shroud 26 may include an annular gaspath wall portion 26*a* and an annular flange 26*b*. The annular flange 26*b* is connected to a locally reinforced intermediate portion 26*j* of the gaspath wall portion 26*a* via an annular structural arm 26*i*. The gaspath wall portion 26*a*, the annular flange 26*b* and the annular structural member 26*i* may be of unitary construction. According to some embodiments, the shroud 26 may be machined to its final shape on a milling or turning machine. However, other manufacturing methods are contemplated as well. The annular flange 26*b* is configured to be bolted to a mating flange (not shown) on the engine structure for supporting the gaspath wall portion 26*a* in a cantilevered manner in position directly over the impeller 22. The gaspath wall portion 26*a* of the impeller shroud 26 encloses the impeller 22, thereby forming a substantially closed system, whereby the compressible fluid enters axially the shroud 26, flows through the gaspath between the shroud 26 and the impeller blades 22*b*, and exits substantially radially outwardly relative to the engine axis 11. The gaspath wall portion 26*a* of the shroud 26 has a gaspath surface 26*c*, which corresponds to the face of the shroud 26 that is exposed to the fluid flow, and an opposed back surface 26*d*. The annular structural member 26*i* extends from the back surface 26*d* of the gaspath wall portion 26*a*.

Still referring to FIG. 2, the gaspath wall portion 26*a* of the impeller shroud 26 has a curved profile from axial to radial, which generally match the curvature of the impeller blades 22*b*, and which extends between an inducer end 26*e* and an exducer end 26*f*. From FIG. 2, it can be appreciated that the inducer end 26*e* and the exducer end 26*f* are supported in a cantilevered manner via the annular flange 26*b* and the annular structural member 26*i*, which extends from the thickening or reinforced intermediate bend region 26*j* of the gaspath wall portion 26*a*.

Referring to FIG. 1, in use, air enters the passages defined circumferentially between the impeller blades 22*b* along a streamwise direction depicted by arrow D from inducer end 22*c* of the impeller 22 to the exducer end 22*d* thereof. The streamwise direction is a direction of the flow from the inducer end 22*c* to the exducer end 22*d* of the impeller 22. While the air flows from the inducer end 22*c* to the exducer end 22*d*, it deviates from being mainly axial relative to the central axis 11 to being mainly radial relative to the central axis 11. Herein, the expression "mainly" as in "mainly axial" implies that a direction is more than 50% axial. Similarly, "mainly radial" implies that a direction is more than 50% radial. As seen in FIG. 1, a diffuser 25 of the centrifugal compressor 14*b* is disposed downstream from the exducer end 22*d* of the impeller 22. The diffuser 25 may be a suitable pipe diffuser or vane diffuser, for example, which serve to diffuse the air exiting the impeller to further increase the pressure thereof.

During operation, the impeller shroud 26 is subject to blade count excitation. The impeller shroud 26 may be stimulated by multiple impulses, which in turn drive responses corresponding to various natural frequencies of the shroud 26 over a variety of engine operating speeds, exposing the impeller shroud 26 to a large variety of aerodynamic stimuli. Such stimuli if not properly accounted for may cause the impeller shroud 26 to undergo high cycle fatigue (HCF) distress. To avoid the crossing of a blade count excitation with the natural frequencies of the shroud 26 and, thus, prevent premature failure of the shroud 26 in high cycle fatigue, it is herein proposed to configure the impeller shroud 26 such that the nodal diameter (ND) modes of the cantilevered end(s), corresponding to the blade count of the impeller 22, are not in the running range of the engine. According to some embodiments, the tuning of the natural frequencies of the impeller shroud 26, such as to avoid shroud natural frequencies which coincide with known rotor induced aerodynamic excitation frequencies, may be achieved by providing a frequency tuning rib in a cantilevered end portion of the impeller shroud 26.

Figure 3:
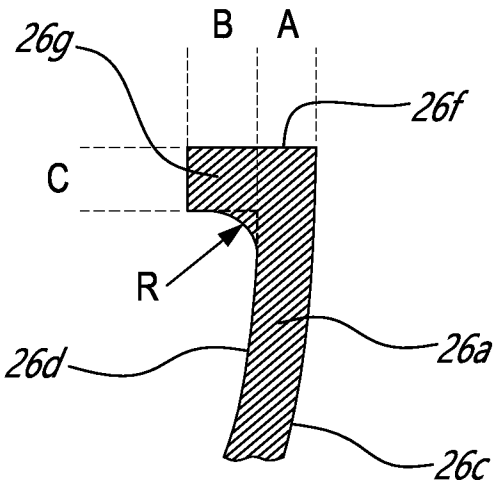
FIG. 3 is an enlarged partial view of the exducer end of the impeller shroud showing axial and radial dimensions of the tuning rib.

Referring to FIGS. 2 and 3, it can be seen that such a tuning rib 26*g* (or stiffener) can be provided at the exducer end 26*f* of the impeller shroud 26. According to some embodiments, the tuning rib 26*g* may be created by extruding the tip of the exducer end 26*f* in a direction parallel to the central axis 11 and in the opposite direction of the axial flow. More particularly, the rib 26*g* may extend axially from the back surface 26*d* of the gaspath wall portion 26*a* of the impeller shroud 26. According to the illustrated embodiment, the rib 26*g* is disposed at the outermost diameter of the shroud 26 and extends circumferentially continuously around the central axis 11, thereby forming a 360 degrees annular rib on the back surface of the shroud. According to other embodiment, the rib 26*g* could be circumferentially segmented so as to include intersegment gaps between adjacent circumferentially extending rib segments. According to still further embodiment, the rib 26*g* could be spaced radially inwardly of the tip of the exducer end 26*f*. For instance, the rib 26*g* could be positioned at a given diameter between the tip of the exducer end 26*f* and the locally reinforced region 26*j*.

The tuning rib 26*g* shown in FIG. 2 stiffens the ND modes concentrated at the cantilever exducer end 26*f* of the impeller shroud 26. As shown in FIG. 3, the gaspath wall portion 26*a* of the impeller shroud 26 has a nominal thickness (A) at the exducer end 26*f* and the tuning rib 26*g* has a length (B)

in the axial direction and a height (C) in the radial direction. Both the length (B) and the height (C) of the tuning rib 26*g* will impact the natural frequency of the shroud 26. These parameters are chosen according to the desired increase in frequency and machining capabilities.

According to one or more embodiments, the following relative dimensions shall be respected in order to have a meaningful impact on the natural frequencies while ensuring that the impeller shroud remains viable from a manufacturing point of view:

$$0.1 \cdot A \leq B \leq 3 \cdot A$$

$$0.1 \cdot B \leq C \leq 3 \cdot B$$

One of the exducer ND mode frequency of an embodiment of the impeller shroud 26 was increased by 12.3% due to the implementation of the rib 26*g* having the above dimensional characteristics.

According to other embodiments, a thickness of the gaspath wall 26*a* of the shroud 26 at the rib 26*g* may be from about 10% to about 200% greater than the nominal thickness A. The tuning rib 26*g* is sized to shift a dynamic response frequency directly at the exducer end 26*f* of the shroud 31 out of an operating range of excitation frequencies. In accordance to one embodiment, the thickness (A+B) of the shroud 26 at the exducer end 26*f* is 138%±5% greater than the nominal thickness A.

Still referring to FIG. 3, it can be seen that a fillet having a radius (R) can be provided between the tuning rib 26*g* and the back surface 26*d* of the gaspath wall portion 26*a* of the impeller shroud 26 to avoid stress concentration.

Figure 4:
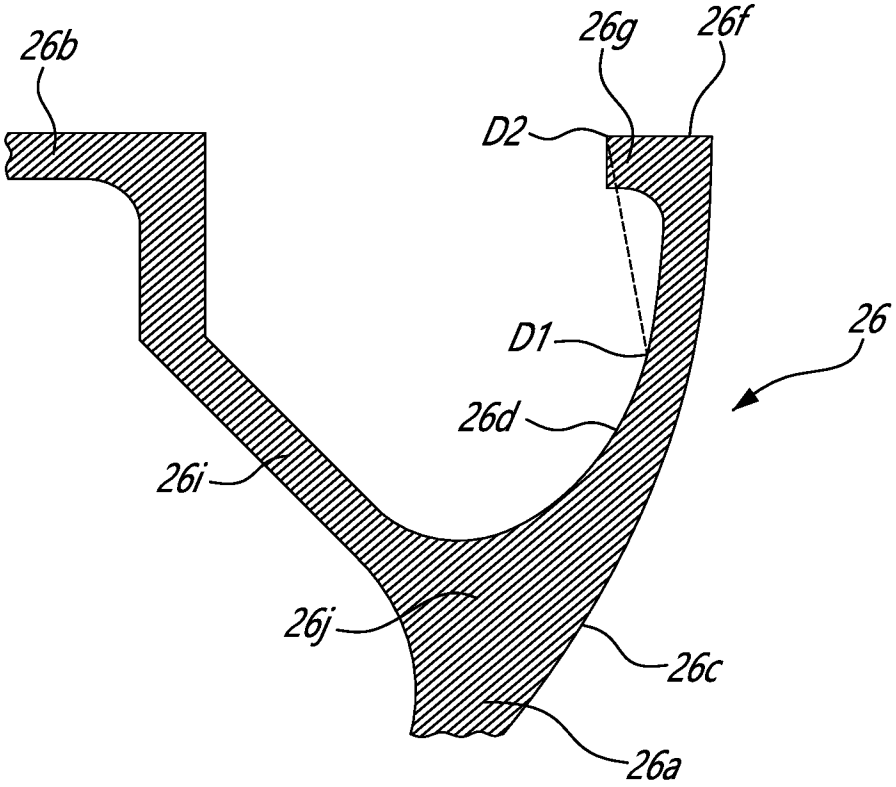
FIG. 4 is an enlarged partial view of the exducer end of the impeller shroud according to another embodiment.

Turning to FIG. 4, it can be seen that the tuning rib 26*g* could have a tapering profile so as to take the form of a gradual increase of the wall thickness of the cantilevered exducer end 26*f* in a radially outward direction. For instance, as depicted by the broken line, the thickness of the gaspath wall portion 26*a* could gradually increase from a chosen diameter D1 along the exducer portion of the shroud (i.e. portion of the shroud radially outwardly of the bend from axial to radial) up to the tip of the shroud exducer end 26*f* that is at the outermost diameter D2 of the impeller shroud 26.

Figure 5:
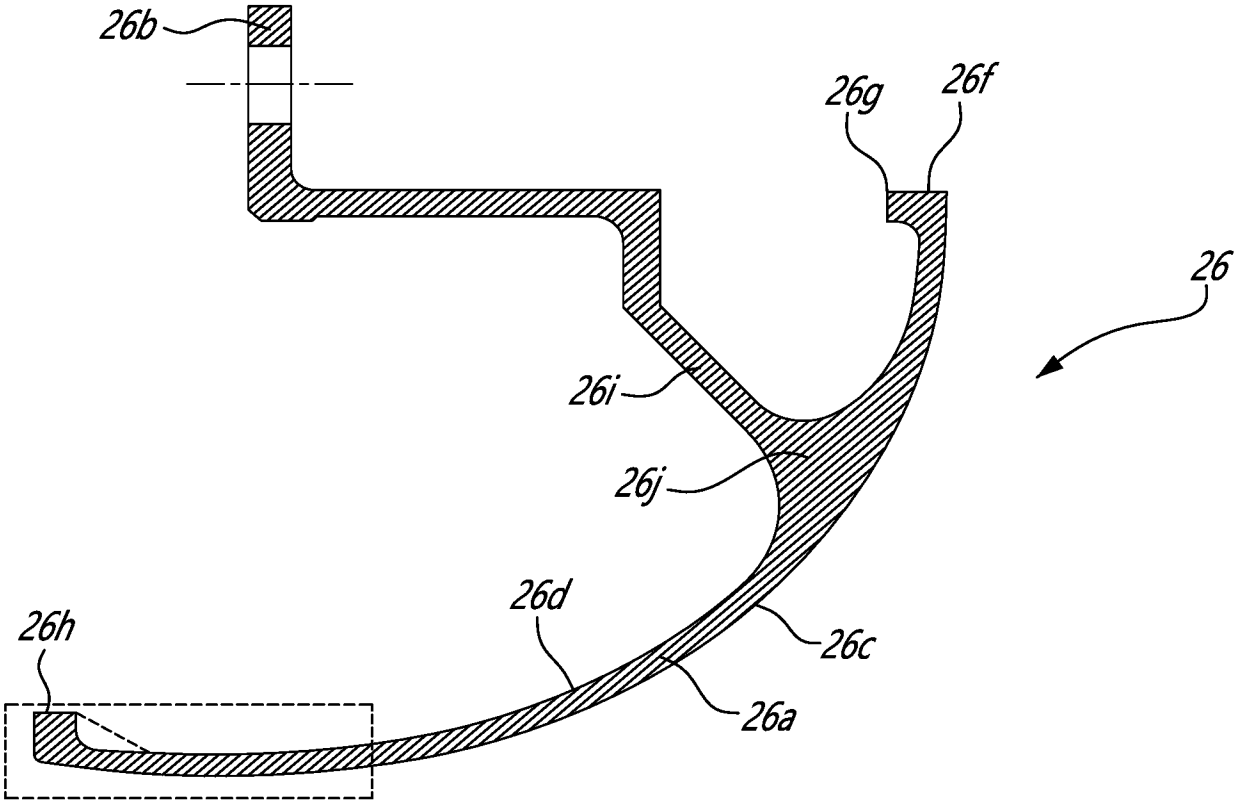
FIG. 5 is a schematic cross-section view of another embodiment of the impeller shroud having a frequency tuning rib at an inducer end thereof.

Referring now to FIG. 5, it can be appreciated that both forms of the above described stiffener or tuning rib could also be used for stiffening the inducer ND modes of the impeller shroud 26 if needed. For instance, a tuning rib 26*h* could extend in a generally radially outward direction from the back surface 26*d* of the gaspath wall 26*a* with the rib positioned at the axial distal end or tip of the cantilevered inducer end 26*e* of the impeller shroud 26 so as to circumferentially extend around the axial inlet end of the impeller shroud 26 (i.e. around axis 11).

It can thus be appreciated that by appropriately sizing and positioning the tuning rib 26*g* on the impeller shroud 26, it is possible to tune the natural frequency of the impeller shroud 26 at the cantilevered inducer and exducer ends 26*e*, 26*f* of the shroud 26, such as to avoid natural frequencies that coincide with known aerodynamic excitation frequencies induced by the impeller 22 during engine operation.

In accordance with another aspect of the technology, there is provided a method of tuning an impeller shroud comprising: (a) designing the impeller shroud; (b) testing the impeller shroud for high cycle fatigue (HCF) problems based on a natural frequency of the impeller shroud; and (c) after steps (a) and (b), altering the natural frequency of the impeller shroud by stiffening the inducer or exducer end of the impeller shroud.

According to a further aspect, stiffening the inducer or exducer end comprises increasing a wall thickness of the shroud at the inducer or exducer end.

Still according to another aspect, increasing the thickness comprises adding a frequency tuning rib on a back surface of the impeller shroud, the tuning rib sized and positioned to increase the ND mode natural frequencies of a cantilevered exducer outside known aerodynamic induced excitation frequencies during engine operation.

In accordance with a still further aspect, there is provided a method of tuning the natural frequency of an impeller shroud surrounding an impeller, the method comprising ascertaining aerodynamic excitation frequencies to which the impeller shroud is subject during use, adjusting the natural frequency of the impeller shroud such as to mitigate the aerodynamic excitation frequencies by adding a tuning rib on the back surface of the impeller shroud, the tuning rib provided at a cantilevered end of the shroud impeller.

The above description is meant to be exemplary only, and one skilled in the art will recognize that changes may be made to the embodiments described without departing from the scope of the invention disclosed. Even though the present description and accompanying drawings specifically refer to aircraft engines and centrifugal compressor therefor, aspects of the present disclosure may be applicable to other applications where impeller type pumps and/or compressors may be found and subject to HCF distress due to blade count excitation.

Still other modifications which fall within the scope of the present invention will be apparent to those skilled in the art, in light of a review of this disclosure, and such modifications are intended to fall within the appended claims.

The invention claimed is:

1. A centrifugal compressor comprising:

an impeller rotatable about a central axis, the impeller having blades extending from a hub to blade tips between an inlet and an outlet; and a shroud annularly extending around the blade tips of the impeller and extending in a streamwise direction between an inducer end at the inlet of the impeller and an exducer end at the outlet of the impeller, the shroud having a gaspath surface facing the impeller and a back surface opposed to the gaspath surface, the back surface having a tuning rib extending therefrom at either or both the inducer end and the exducer end of the shroud, the tuning rib being circumferentially segmented and configured to alter a natural frequency of the shroud so as to avoid coincidence with aerodynamic excitation frequencies to which the shroud is configured to be exposed to during use.

2. The centrifugal compressor defined in claim 1, wherein the exducer end of the shroud is cantilevered, and wherein the tuning rib extends from an outermost diameter of the exducer end of the shroud.

3. The centrifugal compressor defined in claim 2, wherein the tuning rib projects axially from the back surface of the shroud in a direction opposite to a direction of flow through the inducer end of the shroud.

4. The centrifugal compressor defined in claim 2, wherein the shroud has a nominal wall thickness, and wherein a thickness of the exducer end of the shroud at the tuning rib is between 10% and 200% greater than the nominal wall thickness.

5. The centrifugal compressor defined in claim 2, wherein the tuning rib has a tapered profile, a thickness of the tuning rib in an axial direction gradually increasing in a radially outward direction to reach a maximum at an outermost diameter of the exducer end of the shroud.

6. The centrifugal compressor defined in claim 1, wherein the tuning rib is provided at the exducer end of the shroud, wherein the exducer end has a wall thickness A, wherein the tuning rib has a length B in an axial direction and a height C in a radial direction relative to the central axis, and wherein:

$$0.1 \cdot A \leq B \leq 3 \cdot A$$

$$0.1 \cdot B \leq C \leq 3 \cdot B.$$

7. The centrifugal compressor defined in claim 1, wherein the inducer end of the shroud is cantilevered, and wherein the tuning rib is provided at the inducer end.

8. A centrifugal compressor comprising:

an impeller rotatable about a central axis, the impeller having blades extending from a hub to blade tips between an inlet and an outlet; and a shroud annularly extending around the blade tips of the impeller and extending in a streamwise direction between an inducer end at the inlet of the impeller and an exducer end at the outlet of the impeller, the shroud having a gaspath surface facing the impeller and a back surface opposed to the gaspath surface, the back surface having a tuning rib extending therefrom at either or both the inducer end and the exducer end of the shroud, the tuning rib configured to alter a natural frequency of the shroud so as to avoid coincidence with aerodynamic excitation frequencies to which the shroud is configured to be exposed to during use;

wherein the tuning rib is provided at the exducer end of the shroud, wherein the exducer end has a wall thickness A, wherein the tuning rib has a length B in an axial direction and a height C in a radial direction relative to the central axis, and wherein:

$$0.1 \cdot A \leq B \leq 3 \cdot A$$

$$0.1 \cdot B \leq C \leq 3 \cdot B.$$

9. The centrifugal compressor defined in claim 8, wherein the exducer end of the shroud is cantilevered, and wherein the tuning rib extends from an outermost diameter of the exducer end of the shroud.

10. The centrifugal compressor defined in claim 9, wherein the tuning rib projects axially from the back surface of the shroud in a direction opposite to a direction of flow through the inducer end of the shroud.

11. The centrifugal compressor defined in claim 8, wherein the shroud has a nominal wall thickness, and wherein a thickness of the exducer end of the shroud at the tuning rib is between 10% and 200% greater than the nominal wall thickness.

12. The centrifugal compressor defined in claim 8, wherein the tuning rib has a tapered profile, a thickness of the tuning rib in an axial direction gradually increasing in a radially outward direction to reach a maximum at an outermost diameter of the exducer end of the shroud.

13. A centrifugal compressor comprising:

an impeller rotatable about a central axis, the impeller having blades extending from a hub to blade tips between an inlet and an outlet; and a shroud annularly extending around the blade tips of the impeller and extending in a streamwise direction between an inducer end at the inlet of the impeller and an exducer end at the outlet of the impeller, the shroud having a gaspath surface facing the impeller and a back surface opposed to the gaspath surface, the back surface having a tuning rib extending therefrom, the tuning rib configured to alter a natural frequency of the shroud so as to avoid coincidence with aerodynamic excitation frequencies to which the shroud is configured to be exposed to during use, wherein the exducer end of the shroud is cantilevered, the tuning rib extending from an outermost diameter of the exducer end of the shroud, wherein the shroud has a nominal wall thickness, and wherein a thickness of the exducer end of the shroud at the tuning rib is between 10% and 200% greater than the nominal wall thickness.

* * * * *